US006230630B1

(12) United States Patent
Gibson et al.

(10) Patent No.: US 6,230,630 B1
(45) Date of Patent: May 15, 2001

(54) AERODYNAMIC PROJECTILES AND METHODS OF MAKING THE SAME

(75) Inventors: Gary E. Gibson, Riverwoods; Michael A. Varacins, Woodstock, both of IL (US)

(73) Assignee: Perfect Circle Paintball, Inc., Wheeling, IL (US)

( * ) Notice: Subject to any disclaimer, the term of this patent is extended or adjusted under 35 U.S.C. 154(b) by 0 days.

(21) Appl. No.: 09/266,060

(22) Filed: Mar. 10, 1999

(51) Int. Cl.[7] ..... F42B 8/00; F42B 8/04

(52) U.S. Cl. ..... 102/513; 102/511; 102/502; 102/529; 102/508; 102/509; 102/501; 102/477; 102/478; 244/3.23; 244/3.24

(58) Field of Search ..... 102/502, 513, 102/529, 477, 511, 509, 508, 501, 473, 478, 506, 439; 244/3.23, 3.24

(56) References Cited

U.S. PATENT DOCUMENTS

| | | | | |
|---|---|---|---|---|
| 39,942 | * | 9/1863 | McMurtry | 244/3.23 |
| D. 138,288 | | 7/1944 | LaClair . | |
| D. 348,907 | | 7/1994 | Prentice et al. . | |
| 1,088,025 | | 2/1914 | Johnson . | |
| 1,285,599 | * | 11/1918 | Bennett | 244/3.24 |
| 2,105,528 | * | 1/1938 | Foisy | 102/26 |
| 2,172,054 | | 9/1939 | Di Brazza-Savorgnan . | |
| 2,925,276 | | 2/1960 | Leclerc . | |
| 3,037,454 | | 6/1962 | Young . | |
| 3,649,020 | | 3/1972 | Hall . | |
| 3,782,286 | | 1/1974 | Jones et al. . | |
| 3,791,303 | | 2/1974 | Sweeney et al. . | |
| 3,952,662 | * | 4/1976 | Greenlees | 102/92.7 |
| 4,128,059 | * | 12/1978 | Black | 102/92.7 |
| 4,634,606 | | 1/1987 | Skogg . | |
| 4,656,092 | | 4/1987 | Haman et al. . | |
| 4,684,137 | | 8/1987 | Armer, Jr. et al. . | |
| 4,779,535 | | 10/1988 | Maki . | |
| 4,813,635 | * | 3/1989 | Paterson et al. | 244/130 |
| 4,823,702 | | 4/1989 | Woolsey . | |
| 4,895,076 | * | 1/1990 | Looger et al. | 102/439 |
| 4,899,660 | | 2/1990 | Brighton . | |
| 4,932,329 | | 6/1990 | Logie . | |
| 4,942,818 | | 7/1990 | Saxby . | |
| 4,944,521 | | 7/1990 | Greeno . | |
| 4,950,516 | | 8/1990 | Schwab . | |
| 5,001,880 | | 3/1991 | Smith . | |
| 5,009,164 | | 4/1991 | Grinberg . | |
| 5,009,165 | | 4/1991 | Morris . | |
| 5,018,449 | | 5/1991 | Eidson, II . | |
| 5,018,450 | | 5/1991 | Smith . | |
| 5,035,183 | | 7/1991 | Luxton . | |
| 5,121,692 | | 6/1992 | DiCarlo . | |
| 5,254,379 | | 10/1993 | Kotsiopoulos et al. . | |
| 5,393,054 | | 2/1995 | Rouffer . | |
| 5,443,010 | * | 8/1995 | Dahlitz | 102/511 |
| 5,448,951 | | 9/1995 | Olson . | |
| 5,559,304 | * | 9/1996 | Schweiger et al. | 102/501 |
| 5,565,649 | | 10/1996 | Tougeron et al. . | |
| 5,639,526 | | 6/1997 | Kotsiopoulos et al. . | |
| 5,640,945 | | 6/1997 | Slonaker et al. . | |
| 5,654,524 | | 8/1997 | Saxby . | |

* cited by examiner

*Primary Examiner*—Michael J. Carone
*Assistant Examiner*—Lulit Semunegus
(74) *Attorney, Agent, or Firm*—Leydig, Voit & Mayer, Ltd.

(57) ABSTRACT

An aerodynamic projectile, preferably a non-lethal projectile, including a projectile shell having an aerodynamic structure and a controlled center of gravity which exhibits improved aerodynamics and resulting accuracy and which fractures in a predetermined pattern to disperse a fill contained therein. A method of making an aerodynamic projectile.

52 Claims, 8 Drawing Sheets

AERODYNAMIC PROJECTILES AND METHODS OF MAKING THE SAME

FIELD OF INVENTION

The invention relates to aerodynamic projectiles and methods for forming the same which are typically fired by compressed gas guns. More particularly, the invention relates to projectiles having an aerodynamic structure and a controlled center of gravity which exhibits improved aerodynamics and resulting accuracy. Preferably, the projectile is a non-lethal projectile.

BACKGROUND OF THE INVENTION

Compressed gas guns which fire non-lethal projectiles known as paint balls are typically used to mark individuals for future identification without causing injury. Such non-lethal projectiles are used by sportsmen, police, military and other security forces to mark targeted persons participating in mock war games and other training exercises. While these paint balls may also be used during riots as a means of crowd control or in any other situation which mandates a "less than lethal" attack or defense strategy, they provide little deterrence other than marking the targeted individual with paint.

Traditionally, non-lethal projectiles developed for the purpose of riot control have mainly consisted of rubber bullets which often penetrate the skin causing severe injury to the target. Such rubber bullets have often caused much more severe injury than intended. Further, where no injury occurs, the targeted individual may escape identification.

Recently, paint ball projectiles made of a plastic, such as polystyrene, were developed to fracture in a predetermined pattern upon impact with a target. U.S. Pat. Nos. 5,254,379 and 5,639,526 (the disclosures of which are incorporated herein in their entirety) provide a plastic paint ball constructed of a linear polymer of sufficient strength to transport, load, and fire out of a compressed gas gun, which is molecularly oriented such that, upon application of a force at any impact point on the paint ball shell, the shell fractures in a way that greatly reduces the risk of injury. Further, because the plastic paint ball is not water soluble like a gelatinous one, it is not sensitive to the environment and can be filled with a wide variety of components, including aqueous dyes, powders and solids.

While such plastic paint balls effectively mark a target without injury, they do not adequately stun or immobilize a target, as is needed for the purpose of riot control. Further, traditional paint balls, whether the shell is formed from gelatin or plastic, suffer from inaccuracy, especially when launched from a distance greater than 100 feet from the target. This inaccuracy is due, in part, to the spherical shape and smooth surface of the paint ball projectile. The spherical shape creates an irregular, turbulent flow around the projectile causing an unstable flight pattern. Also, when a smooth surfaced paint ball is fired from a smooth-bore, uniform barrel, the result is a ball generally without spin, which behaves unpredictably. Additionally, due to inherent manufacturing difficulties, most paint ball projectiles are not perfectly spherical. For example, gelatinous paint balls tend to be at least 0.015" out of round. While plastic shells are usually only about 0.002" out of round, even this seemingly small oblong shape imparts inaccuracy to the fired paint ball projectile.

Another problem is that the effective range of current paint ball projectiles is very limited. This is because paint balls are typically large projectiles, are not very dense, and are fired at low muzzle velocities, all of which creates a substantial amount of drag in comparison to the momentum provided to the paint ball upon firing with a compressed gas gun.

Thus, there remains a need for a projectile that is effective in marking and stunning, or otherwise immobilizing, a target. Preferably marking occurs without causing serious injury or death to the target. There remains a further need to produce such a projectile that has increased accuracy and range when used with the launching power of compressed gas guns.

SUMMARY OF THE INVENTION

Accordingly, the present invention provides an improved projectile that overcomes the deficiencies of the prior art and is useful for the purpose of riot control. The present invention preferably provides a non-lethal projectile which shell fractures upon impact and has sufficient mass to stun or otherwise immobilize the target and mark the target preferably without killing or seriously injuring the target.

A projectile shell of a first embodiment of the present invention comprises a generally hemispherical portion and a generally cylindrical portion. The hemispherical portion has a wall with an inner surface and an outer surface wherein the inner surface forms a hemispheric interior volume. The cylindrical portion also has a wall with an inner surface and an outer surface and the inner surface forms a hemispheric interior volume having the same general shape and volume as the interior volume of the hemispherical portion. The hemispherical portion is joined to the cylindrical portion at a rim. Preferably, the cylindrical portion has a length which is at least about equal to one-half the diameter of the hemispherical portion.

Also preferably, the projectile shell is formed from a linear polymer such as polystyrene which is molecularly oriented along circumferential lines in the hemispherical portion extending from the apex of the hemispherical portion toward the cylindrical portion. In one embodiment of the present invention, the projectile shell hemispherical portion has a wall thickness of from about 0.005 inches to about 0.040 inches. Preferably, the wall thickness at or near the rim is greater than the wall thickness at the apex of the hemispherical portion. The cylindrical portion has a wall thickness of from about 0.025 inches to about 0.050 inches measured at or near the rim where the cylindrical portion is joined to the hemispherical portion.

The projectile shell of the present invention may further comprise a circular insert having a first wall facing the interior volume of the hemispherical portion and a second wall facing the interior volume of the cylindrical portion. The circular insert is placed between the hemispherical and cylindrical portions prior to joining the hemispherical portion to the cylindrical portion. The circular insert effectively isolates the interior volume of the hemispherical portion from the interior volume of the cylindrical portion. Preferably, the circular insert has a thickness of from about 0.010 inches to about 0.040 inches and a diameter of from about 0.620 inches to about 0.635 inches.

In a second embodiment of the present invention, a projectile shell is provided which comprises a generally hemispherical portion and a frustum portion. The hemispherical portion has a wall with an inner surface and an outer surface wherein the inner surface forms a hemispheric interior volume. The frustum portion also has a wall having an inner surface and an outer surface. The inner surface forms an interior volume having the same general shape and volume as the interior volume of the hemispherical portion.

The frustum has a diameter at its wide end which is about equal to the diameter of the hemispherical portion and a length which is at least about equal to one-half of that diameter. The hemispherical portion is joined to the wide end of the frustum portion at a rim.

Preferably, the projectile shell of the second embodiment of the present invention is formed from a linear polymer such as polystyrene which is molecularly oriented along circumferential lines in the hemispherical portion extending from the apex of the hemispherical portion toward the frustum portion. In one embodiment of the second embodiment of the present invention, the projectile shell hemispherical portion has a wall thickness of from about 0.005 inches to about 0.040 inches. Preferably, the wall thickness at or near the rim is greater than the wall thickness at the apex of the hemispherical portion. The frustum portion has a wall thickness of from about 0.025 inches to about 0.050 inches measured at or near the rim where the frustum portion is joined to the hemispherical portion.

The projectile shell of the second embodiment of the present invention may also further comprise a circular insert having a first wall facing the interior volume of the hemispherical portion and a second wall facing the interior volume of the frustum portion. The circular insert is placed between the hemispherical and frustum portions prior to joining the hemispherical portion to the frustum portion. The circular insert effectively isolates the interior volume of the hemispherical portion from the interior volume of the frustum portion. Preferably, the circular insert has a thickness of from about 0.010 inches to about 0.040 inches and a diameter of from about 0.620 inches to about 0.635 inches.

Preferably, the frustum portion includes at least four fins spaced equal distances apart on its exterior surface. More preferably, the frustum portion includes sixteen fins spaced equal distances apart on its exterior surface. Even more preferably is that each of the fins curves around the exterior surface about 0.0708 revolutions per inch of fin length.

The present invention further relates to a projectile comprising a shell having a hemispherical portion and a cylindrical portion shell. The shell's hemispherical portion has an inner surface and an outer surface forming a wall and a hemispheric interior volume. The cylindrical portion also has an inner surface and an outer surface which forms a wall and the inner surface forms a hemispheric interior volume having the same general shape and volume as the interior volume of the hemispherical portion. The cylindrical portion also has a length which is at least about equal to one-half the diameter of the hemispherical portion. The hemispherical portion is joined to the cylindrical portion at a rim. The projectile of the present invention further includes a means for marking a target struck by the projectile to permit identification of the target. The means for marking the target is preferably located at least within the interior volume of the hemispherical portion. More preferably, the projectile of the present invention further comprises means for immobilizing a target struck by the projectile. Preferably, this means for immobilizing the target is located at least within the interior volume of the hemispherical portion.

In the projectile of the present invention, the means for marking a target is preferably selected from the group consisting of a liquid dye, a powder dye, a water soluble dye, a permanent dye, an infra red dye, an ultra violet dye, a dye that glows in the dark, and a miniature radiotransmitter. The means for immobilizing the target is preferably selected from the group consisting of a liquid irritant, a powder irritant, a gaseous irritant, a pepper powder, tear gas, a malodorant or other noxious chemical, and a weighting agent. Most preferably, the weighting agent is bismuth or lead which is present in an amount of from 2 grams to about 15 grams.

A projectile of the present invention is further provided in a second embodiment which comprises a shell having a generally hemispherical portion and a frustum portion. The hemispherical portion has an inner surface and an outer surface forming a wall and a hemispheric interior volume. The frustum portion also has an inner surface and an outer surface which forms a wall and the inner surface forms a hemispheric interior volume having the same general shape and volume as the interior volume of the hemispherical portion. The frustum portion has a diameter at its wide end which is about equal to the diameter of the hemispherical portion and a length which is at least about equal to one-half that diameter. The hemispherical portion is joined to the wide end of the frustum portion at a rim. The projectile further includes a means for marking a target struck by the projectile to permit identification of the target. The means for marking the target is located at least within the hemispherical portion interior volume.

Preferably the projectiles of the present invention include at least four fins spaced equal distances apart on the exterior surface of either the cylindrical portion or the frustum portion and more preferably sixteen fins are used. Even more preferably is that each of the fins curves around the exterior surface about 0.0708 revolutions per inch of fin length. Also preferably, the cylindrical portion or the frustum portion has a length greater than one-half of the diameter of the hemispherical portion.

Further provided is a method producing the projectile of the present invention comprising injecting a linear polymer into a first mold to form a hemispherical portion shell having a hemispheric inner wall, a hemispheric outer wall, a hemispherically shaped interior volume, and a fill port, where the inner and outer walls also form a rim. Further, a linear polymer is injected into a second mold forming a cylindrical portion shell having a hemispheric inner wall, a cylindrical outer wall, an interior volume, and a fill port. The cylindrical portion inner and outer walls form a rim having a profile suitable for mating with the rim formed in the hemispherical portion. A circular insert is also molded. Any desired weighting agent is placed within the hemispherical shell, the circular insert is then placed between the hemispherical portion and the cylindrical portion, and the hemispherical portion and the cylindrical portion are joined together about their rims, trapping the circular insert in place and sealing and isolating the interior volumes of the hemispherical portion and cylindrical portion from one another. Preferably, any liquid, such as a dye, for marking a target struck by the projectile is then dispensed into the hemispherical portion using its fill port and the fill port is then sealed. More preferably, water and/or other liquid means for marking a target struck by the projectile is also dispensed into the interior volume of the cylindrical portion using its fill hole. Again, the fill hole is sealed. Finally, any flashing removed.

Also provided is a method producing a second embodiment of the projectile of the present invention comprising injecting a linear polymer into a first mold to form a hemispherical portion shell having a hemispheric inner wall, a hemispheric outer wall, a hemispherically shaped interior volume, and a fill port, where the inner and outer walls also form a rim. Further a linear polymer is injected into a second mold forming a frustum portion shell having a hemispheric inner wall, a frustum shaped outer wall, an interior volume, and a fill port. The frustum portion inner and outer walls form a rim having a profile suitable for mating with the rim formed in the hemispherical portion. A circular insert is also molded. Any desired weighting agent is placed within the hemispherical shell, the circular insert is then placed between the hemispherical portion and the frustum portion, and the hemispherical portion and the frustum portion are joined together about their rims, trapping the circular insert in place and sealing and isolating the interior volumes of the hemispherical portion and frustum portion from one another. Preferably, any liquid, such as dye, for marking a target struck by the projectile is then dispensed into the hemispherical portion using its fill port and the fill port is then sealed. More preferably, water and/or other liquid means for marking a target struck by the projectile is also dispensed into the interior volume of the frustum portion using its fill hole. Again, the fill hole is sealed. Finally, any flashing is removed.

DETAILED DESCRIPTION

Referring generally to the above figures wherein like numerals indicate like parts, a new, preferably non-lethal, projectile is disclosed which may be fired from generally available compressed gas guns such as paint ball guns with little or no modification to the gun while making use of a minimally modified cartridge magazine for feeding projectiles to the gun. Generally little or no modification of the currently available guns will be required although a larger air volume may be required to obtain projectile firing distances acceptable to users such as police and military personnel. The projectile has a maximum diameter of about 0.690 inches, the diameter of a typical paint ball. The projectile may have varying lengths depending upon the desired degree of accuracy, although, preferably, in one embodiment, the length should not exceed 0.690 inches to permit the use of generally available paint ball style guns for firing of the new projectiles.

Figure 1A:
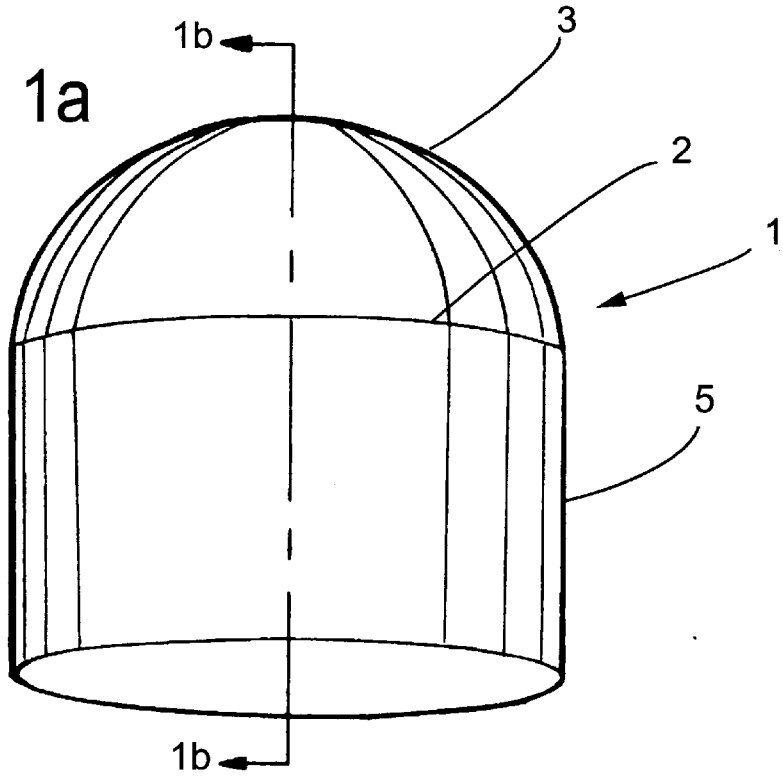
FIG. 1*a* is a perspective view of a first embodiment of the projectile according to the present invention.
Figure 1B:
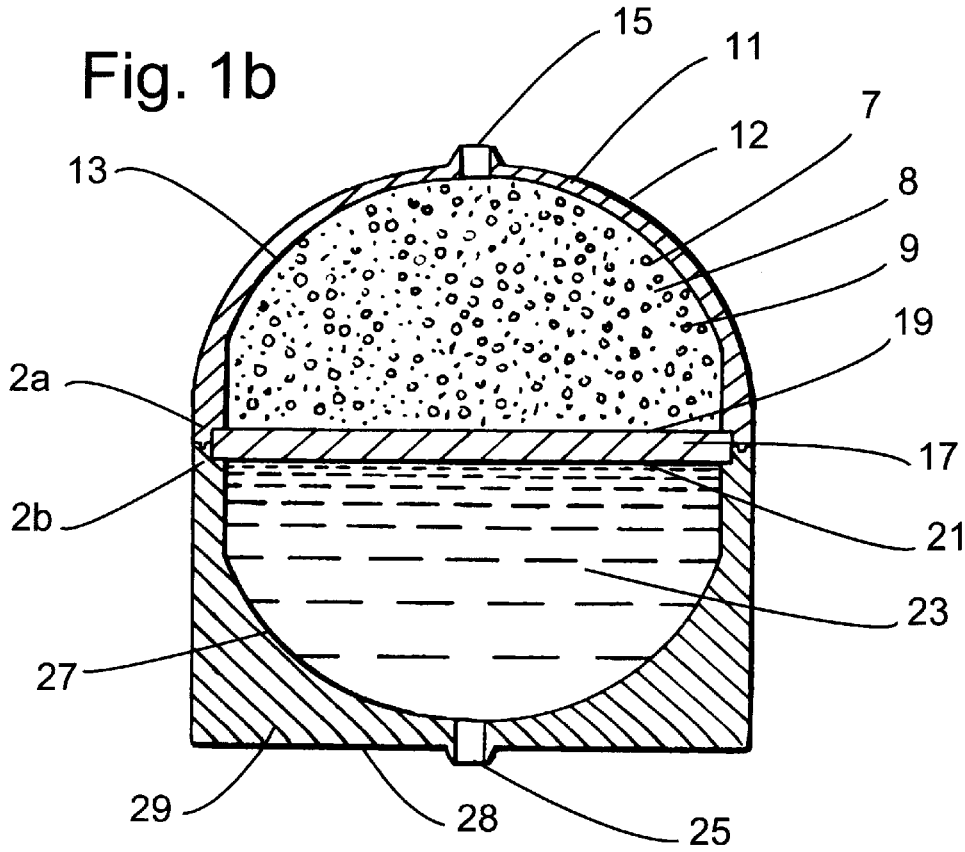
FIG. 1*b* is a cross-sectional view along the line 1*b* of the projectile of FIG. 1*a*.

In its most basic embodiment as seen in FIGS. 1*a* & 1*b*, the projectile 1 comprises a generally hemispherical portion 3 joined to a generally cylindrical portion 5.

The hemispherical portion 3 may be formed from one half of a paint ball shell. A typical paint ball is formed from two hemispherical shells which are then joined together. The hemispherical portion 3 of the present invention is formed from a paint ball hemispheric shell. To accommodate a variety of materials which may be carried by the projectile of the present invention, such as water, preferably, the hemispherical portion 1 is made from a plastic or other moisture resistant material which, although moisture resistant, preferably does not present a projectile which develops generally lethal force. Such a shell generally has an outside diameter of about 0.680 inches. For instance, the hemispherical portion 3 may be made according to U.S. Pat. Nos. 5,254,379 and 5,639,526. Such a hemispherical shell is resistant to moisture, of sufficient strength to permit manufacture of the desired projectile and yet at the same time presenting a readily frangible leading surface permitting ready marking of the individual struck by the projectile in a stunning, yet preferably non-lethal manner.

One suitable plastic for use in manufacturing the hemispherical portion 3 is a polystyrene marketed under the tradename Novacor and distributed by Polymerland, Inc. This polystyrene is a linear polymer which yields a hemispherical portion that is impervious to water and does not dissolve when contacted by rain or sweat or when placed in a warm humid environment. This impervious nature allows the shell to be used to contain a variety of products including water, smoke, tear gas and other items unsuitable for placement in known gelatin shells.

The hemispherical portion 3 may be formed from a linear polymer in several ways including injection molding and blow molding. However, the preferable method of forming the hemispherical portion 3 of the invention is by injection molding of a linear thermoplastic polymer. In injection molding, the thermoplastic polymer is heated and then injected under high pressures into a mold. Using injection molding, the hemispherical portion 3 may have a thinner, more uniform wall structure.

Figure 1C:
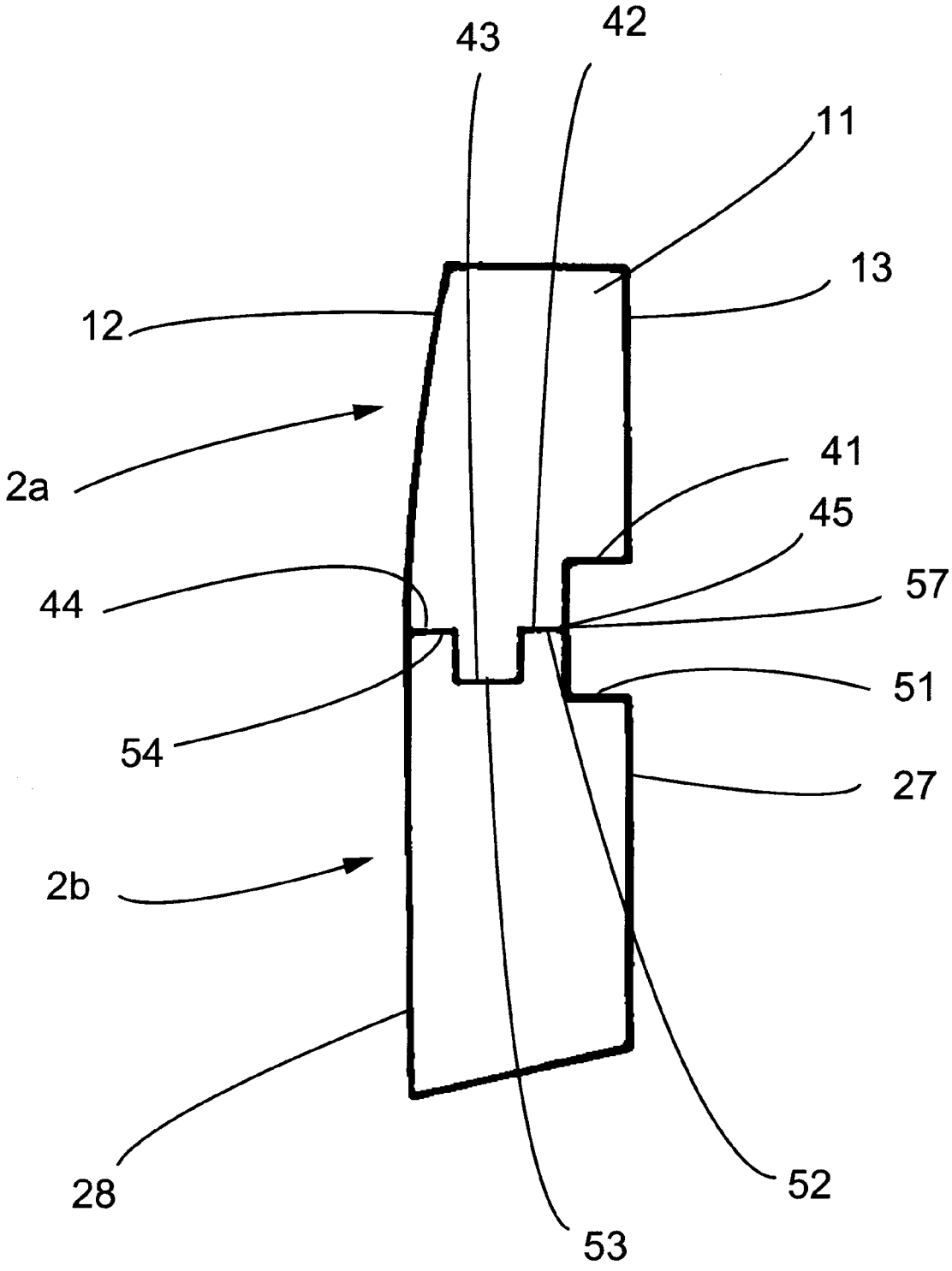
FIG. 1*c* is an enlarged cross-sectional view of the preferred rim shape of the projectile shell of the present invention.

The hemispherical portion 3 generally includes a wall 11 in a hemispherical shape which has an inner surface 13 and an outer surface 12 which forms the wall 11 generally having a thickness of about 0.005 inches to about 0.040 inches. The wall 11 forms a rim 2*a* which may be shaped in a variety of known patterns which permit the joining of the hemispherical portion 3 to the cylindrical portion 5. The shape of the rim 2*a* is determined to some extent by the manner in which the cylindrical and hemispherical portions are to be joined—i.e. by solvent welding or by ultrasonic welding. A preferred rim 2*a* shape is illustrated at FIG. 1*c*. Beginning at the outer wall 12, a first shoulder 44 is molded in the outer wall 12 which is approximately 0.0095 inches from the original rim 2*a* of the hemispherical portion 3 and approximately 0.011 inches deep. The original surface of the rim 2*a* is then left to create a second shoulder 43 for a thickness of 0.011 inches.

A third shoulder 42 equal in width and depth to the first shoulder 44 is then molded in the original rim 2*a*. Finally, a fourth shoulder 41 is molded which, from the edge 45 of the third shoulder 41 to the shoulder 42, is a approximately one-half of the thickness of the circular insert 17 and is molded approximately 0.010 inches into the wall 11. This rim profile is created to match with the rim profile of the cylindrical portion 5 and is especially suitable when using ultrasonic or solvent welding to connect the hemispherical portion 3, the circular insert 17, and the cylindrical portion 5.

At a point on the hemispherical portion 3, preferably the apex, a fill hole 15 is provided for the introduction of material into the projectile after the hemispherical portion 3 is joined to the cylindrical portion 5. After introduction of the material through the fill hole 15, the fill hole is sealed and a generally smooth surface is presented by the projectile in the region of the fill hole 15.

The cylindrical portion 5 may be formed from a variety of materials resistant to water such as plastics such as polystyrene. To simplify manufacturing and to permit easy joining of the cylindrical portion 5 to the hemispherical portion 3, the two portions are preferably manufactured from the same material.

The cylindrical portion 5 may be formed from a linear polymer in several ways including injection molding and blow molding. However, the preferable method of forming the cylindrical portion 5 of the invention is by injection molding of a linear thermoplastic polymer. In injection molding, the thermoplastic polymer is heated and then injected under high pressures into a mold. Using injection molding, the cylindrical portion 5 may have a thinner rim structure and a more uniform wall structure. Preferably, the cylindrical portion is manufactured by injection molding according to the same procedure taught in U.S. Pat. Nos. 5,254,379 and 5,639,526.

One suitable plastic for use in manufacturing the cylindrical portion 5 is a polystyrene marketed under the tradename Novacor and distributed by Polymerland, Inc. This polystyrene is a linear polymer which yields a cylindrical portion that is impervious to water and does not dissolve when contacted by rain or sweat or when placed in a warm humid environment. This impervious nature allows the shell to be used to contain a variety of products including water, smoke, tear gas and other items unsuitable for placement in known gelatin shells.

The cylindrical portion has an overall length of about 0.340 inches and an overall diameter equal to that of the hemispherical portion 3. The cylindrical portion 5 as seen in FIG. 1*b* includes a wall 29 having an inner surface 27 and an outer surface 28. The wall 29 forms a volume generally equal to the volume within the hemispherical portion 3 in the same general configuration and shape of the interior of the hemispherical portion 3. As a result, the cylindrical portion 5 wall 29 has a varying thickness. Preferably when in the form of the invention as seen in FIGS. 1*a* & 1*b*, the wall 29 has a thickness of about 0.025 inches to about 0.050 inches at the rim 2*b* where the cylindrical portion 5 is joined to the hemispherical portion 3. The wall 29 thickness then is adjusted to obtain the desired internal volume and shape for the cylindrical portion 5.

A preferred rim shape 2*b* for the cylindrical portion 5 is illustrated at FIG. 1*c*. Beginning at the outer wall 28, a first shoulder 54 of about 0.013 inches deep and about 0.0098 inches to about 0.0103 inches wide is left from the original rim 2*b* which is sized to mate with the first shoulder 44 of the hemispherical rim 2*a*. A slot 53 is then molded in the cylindrical rim 2*b* with a width of about 0.0095 inches (for ultrasonic welding) or about 0.0105 inches (for solvent welding) and a depth of about 0.013 inches sized to mate with the second shoulder 43. A second shoulder 52 is formed from the original surface of the original cylindrical rim 2*b*. The second shoulder 52 is about 0.013 inches deep and is sized to mate with the third shoulder 42 of the hemispherical rim 2*a*.

Finally, a third shoulder 51 is molded which, from the edge 57 of the second shoulder 52 to the third shoulder 51, is approximately one-half of the thickness of the circular insert 17 and is molded approximately 0.010 inches into the wall 27. This rim profile is created to match with the rim profile of the hemispherical portion 3, permit capturing of the circular insert 17, and is especially suitable when using ultrasonic or solvent welding to connect the hemispherical portion 3, the circular insert 17, and the cylindrical portion 5.

The cylindrical portion 5 includes a fill hole 25 for the introduction of material into the cylindrical portion after it is joined to the hemispherical portion 3. After introduction of the material through the fill hole 25, the fill hole is sealed and a generally smooth surface is presented by the projectile in the region of the fill hole 25.

Prior to joining the hemispherical portion 3 to the cylindrical portion 5 at the rim 2, a circular insert 17 having a first wall 19 facing the interior volume of the hemispherical portion 3 and a second wall 21 facing the interior volume of the cylindrical portion 5 is preferably placed between the hemispherical and cylindrical portions. The circular insert 17 preferably has a thickness of about 0.010 inches to about 0.040 inches and a diameter of about 0.620 inches to about 0.635 inches. The circular insert 17 isolates the interior volume of the hemispherical portion 3 from the interior volume of the cylindrical portion 5, allowing differing materials to be inserted into each volume.

The circular insert 17 may be formed from a variety of materials resistant to water and having the appropriate thermal properties. Preferably, the circular insert 17 is formed from a plastic or other moisture resistant material that will not bond with the material from which the hemispherical and cylindrical portions are formed. One suitable plastic for use in manufacturing the circular insert 17 is an acetal homopolymer. The insert 17 is fit between the rim areas 2*a* & 2*b* of the hemispherical and cylindrical portions 3 & 5. When the rims 2*a* and 2*b* are joined to form the rim 2, the insert 17 is integrated into the rim, thereby sealing the interior volumes of both the cylindrical portion 5 and the hemispherical portion 3 and isolating one interior volume from the other.

Preferably, the hemispherical portion 3, the cylindrical portion 5 and the circular insert 17 are each formed by injection molding a suitable plastic. Various advantages flow readily from the construction of the paint ball shell 3 from a linear polymer. A particularly suitable plastic for the hemispherical and cylindrical portions is a linear polymer such as polystyrene although any workable plastic or other comparable material may be used. Linear polymers are particularly suitable because they are easily handled and molded into easily controlled accurate shapes. For instance, the hemispherical portion 3 of the present invention when formed from linear polystyrene may be constructed within a tolerance of less than 0.002 inches out of round.

Once the three component parts are prepared, they are joined together, preferably by ultrasonic welding although other suitable techniques such as solvent welding may be used employing conventional techniques. Following the joining of the three component pieces, material may be injected into the interior volumes of the hemispherical portion 3 and the cylindrical portion 5 through the appropriate fill holes. The fill holes may then be sealed using conventional techniques such as a fill and seal injection needle.

Figure 2A:
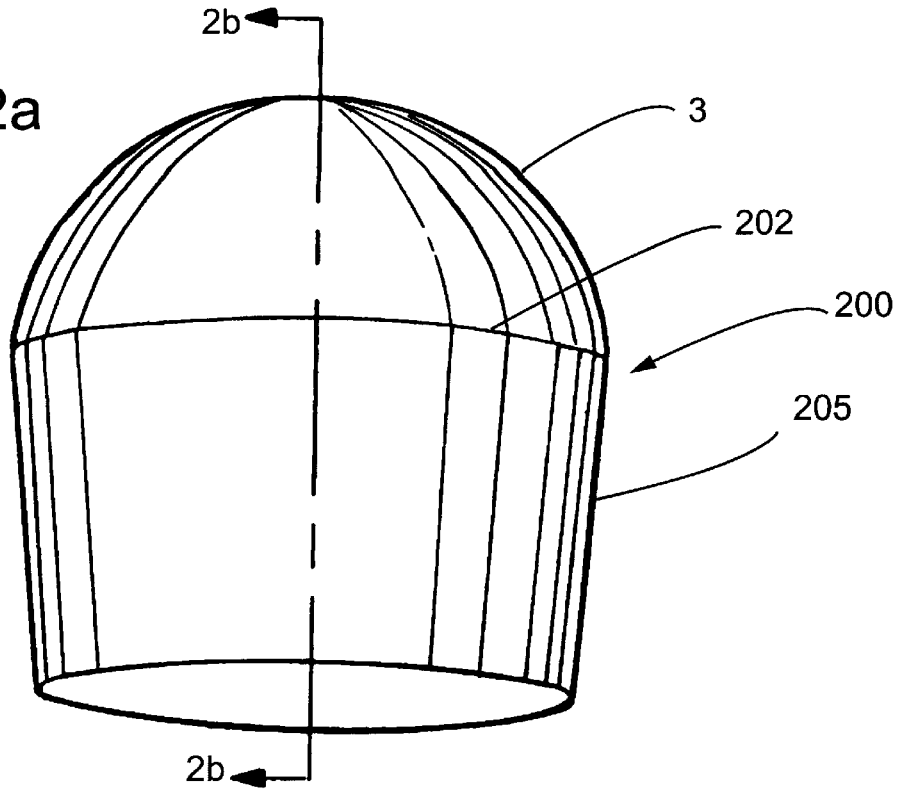
FIG. 2*a* is a perspective view of a second embodiment of the projectile according to the present invention.
Figure 2B:
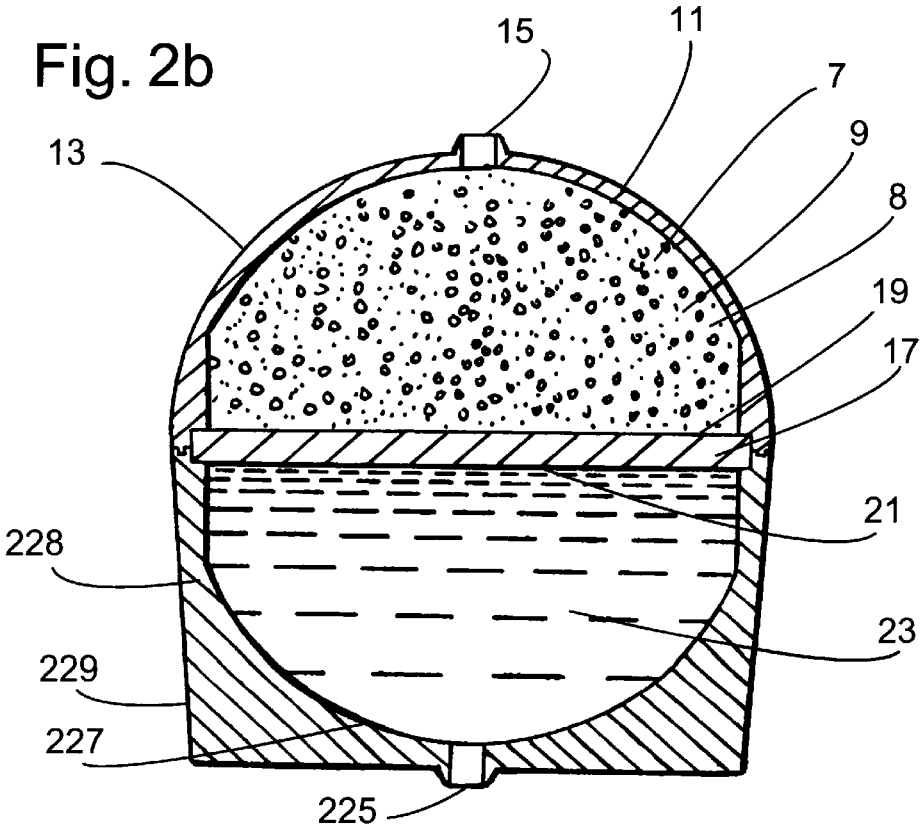
FIG. 2*b* is a cross-sectional view along the line 2*b* of the projectile of FIG. 2*a*.

In a second embodiment 200 of the present invention, as seen in FIGS. 2*a* and 2*b*, a hemispherical portion 3, a circular insert 17, and a frustum shaped cylinder 205. The first hemispherical portion 3 is constructed as described above in relation to FIGS. 1*a*, 1*b* & 1*c*. Likewise, the circular insert is constructed as discussed above. Rather than the cylindrical portion 5 described above, a hollow frustum 205 replaces the cylindrical portion 5. The hollow frustum tapers from a diameter equal to that of the hemispherical portion 3 of about 0.680 inches to a minimum diameter of about 0.625 inches at its furthest extent.

The hollow frustum 205 as seen in FIG. 2*b* includes a wall 229 having an inner surface 227 and an outer surface 228. The wall 229 forms a volume generally equal to the volume within the hemispherical portion 3 in the same general configuration and shape of the interior of the hemispherical portion 3. As a result, the hollow frustum 205 wall 229 has a varying thickness. Preferably when in the form of the invention as seen in FIGS. 2*a* & 2*b*, the wall 229 has a thickness of about 0.025 inches to about 0.050 inches at the rim 202*b* where the hollow frustum 205 is joined to the hemispherical portion 3. The wall 229 thickness then is adjusted to obtain the desired internal volume and shape for the hollow frustum 205.

Figure 2C:
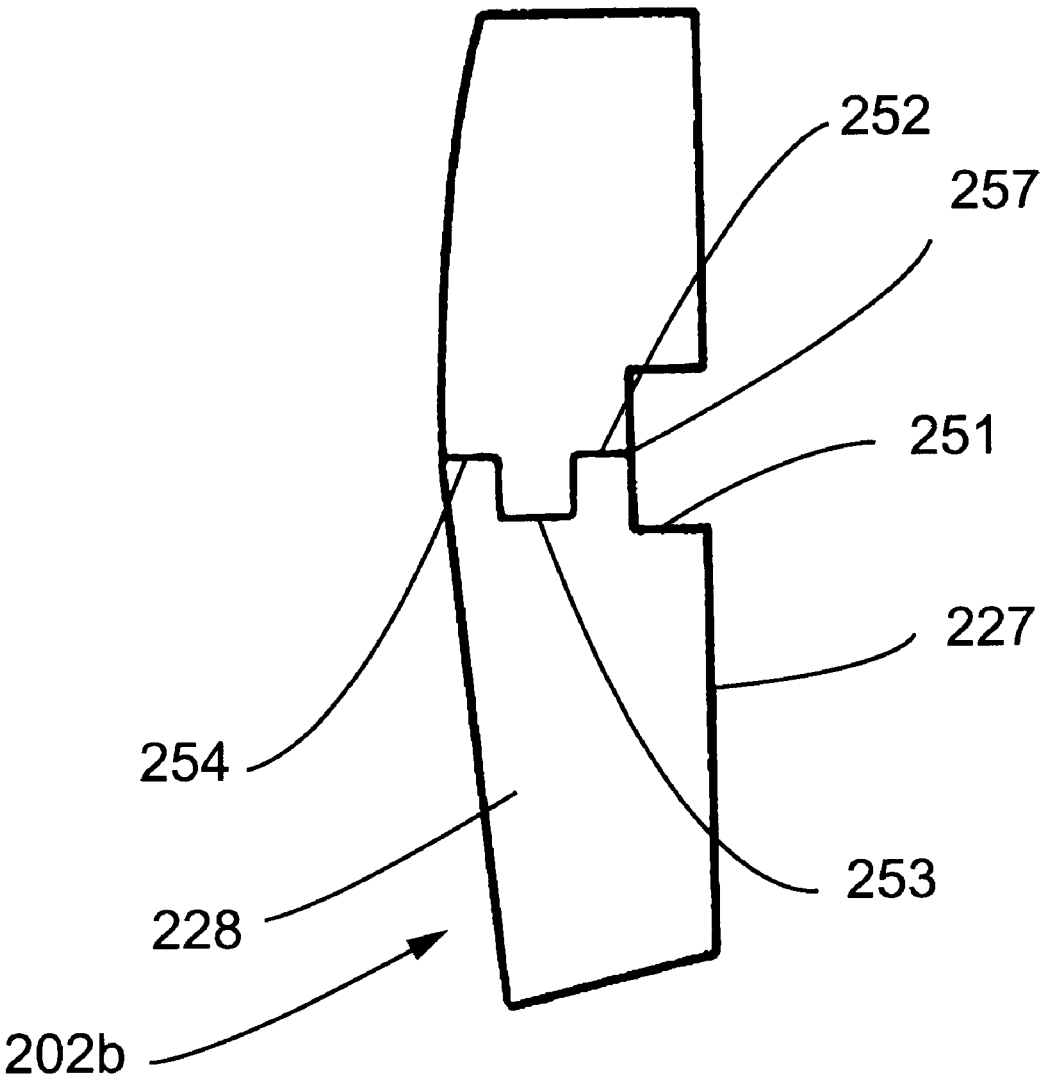
FIG. 2*c* is an enlarged cross-sectional view of the preferred rim shape of a second embodiment of the present invention.

A preferred rim shape 202*b* for the hollow frustum 205 is illustrated at FIG. 2*c*. Beginning at the outer wall 228, a first shoulder 254 of about 0.013 inches deep and about 0.0098 inches to about 0.013 inches wide is left from the original rim 202*b*, which is sized to mate with the first shoulder 44 of the hemispherical rim 2*a*. A slot 253 is then molded in the hollow frustum rim 202*b* with a width of about 0.0095 inches (for ultrasonic welding) or about 0.0105 inches (for solvent welding) and a depth of about 0.013 inches sized to mate with the second shoulder 43 of the hemispherical rim 2*a*. A second shoulder 252 is formed from the original surface of the original hollow frustum cylindrical rim 202*b*. The second shoulder 252 is about 0.013 inches deep and is sized to mate with the third shoulder 42 of the hemispherical rim 2*a*. Finally, a third shoulder 251 is molded which, from the edge 257 of the second shoulder 252 to the third shoulder 251, is approximately one-half of the thickness of the circular insert 17 and is molded approximately 0.010 inches into the wall 27. This rim profile is created to match with the rim profile of the hemispherical portion 3, permit capturing of the circular insert 17, and is especially suitable when using ultrasonic or solvent welding to connect the hemispherical portion 3, the circular insert 17, and the hollow frustum 205.

The hollow frustum 205 includes a fill hole 225 for the introduction of material into the hollow frustum 205 after it is joined to the hemispherical portion 3. After introduction of the material through the fill hole 225, the fill hole is sealed and a generally smooth surface is presented by the projectile in the region of the fill hole 225.

As with the above described cylindrical portion 5, the hollow frustum 205 may be formed from a variety of water resistant materials such as plastics such as polystyrene also mentioned in relation to the cylindrical portion 5. To simplify manufacturing and to permit easy joining of the hollow frustum 205 to the hemispherical portion 3, the two portions are again preferably manufactured from the same material. Preferably, the hollow frustum 205 is manufactured by injection molding according to the same procedure taught in U.S. Pat. Nos. 5,254,379 and 5,639,526.

Figure 3A:
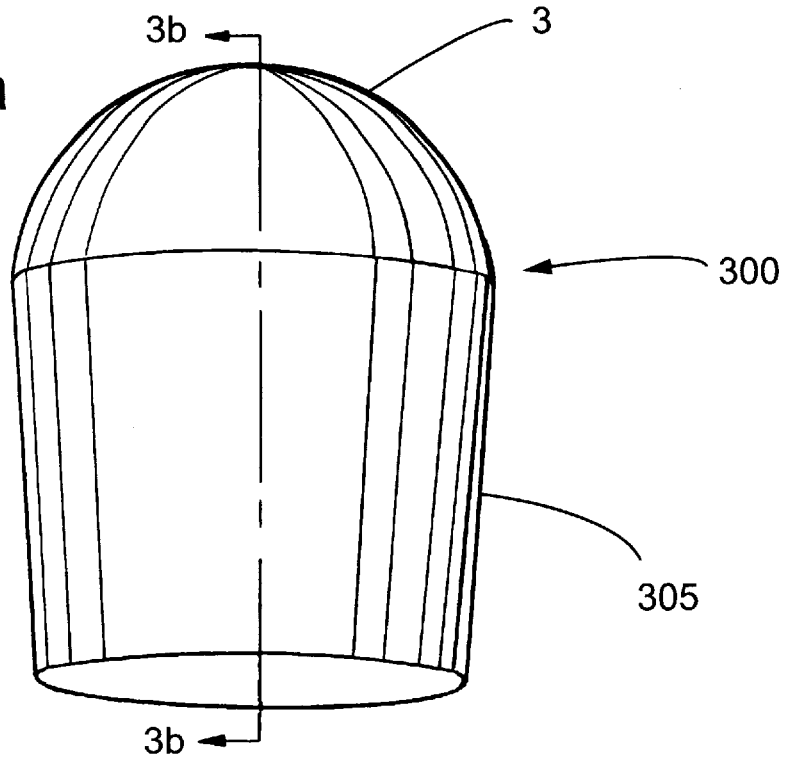
FIG. 3*a* is a perspective view of a third embodiment of the projectile according to the present invention.
Figure 3B:
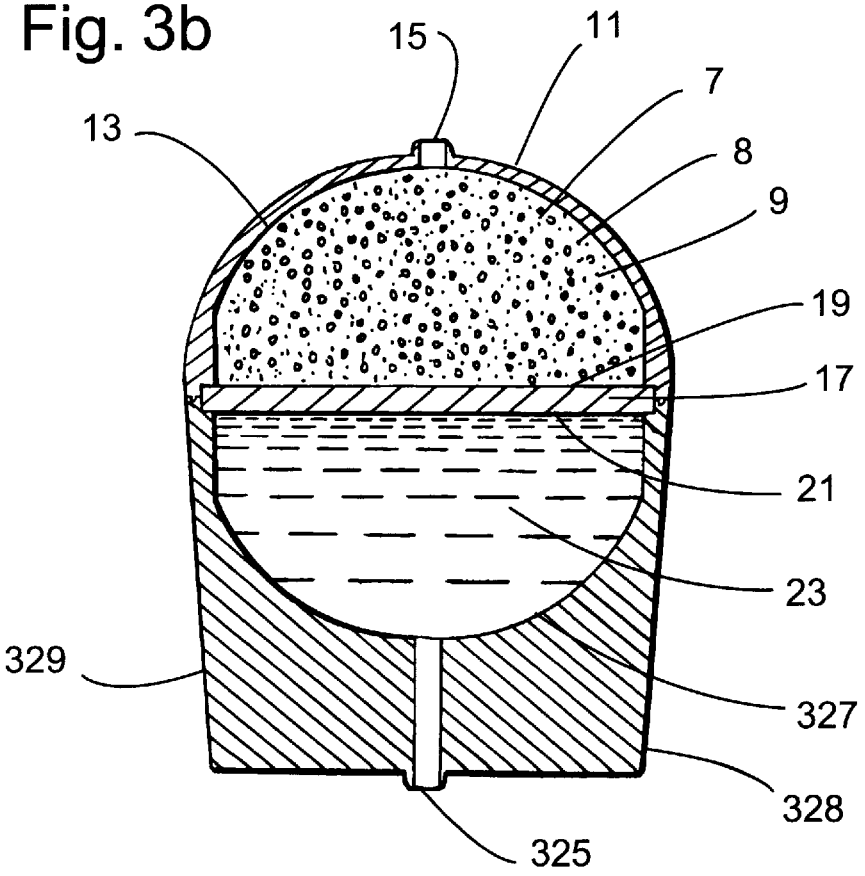
FIG. 3*b* is a cross-sectional view along the line 3*b* of the projectile of FIG. 3*a*.

A third embodiment 300 of the present invention is seen in FIGS. 3*a* and 3*b*. In this embodiment, a hemispherical portion 3, a circular insert 17, and a long hollow frustum 305 are joined to form a non-lethal projectile. This embodiment is identical to that seen in FIGS. 2*a*, 2*b* & 2*c* except that the hollow frustum 305 is extended for a greater length of about 0.500 inches. It should be noted that a projectile formed from a frustum of this extended length may require the use of a modified paintball gun. The three pieces are connected together in the same manner as described in relation to the second embodiment 200 described above.

As noted above, the third embodiment 300 of this projectile of the present invention includes a long hollow frustum 305. While the hollow frustum is extended, its interior hollow volume is limited to the same general configuration and shape of the interior of the hemispherical portion 3. As a result, the hollow frustum 305 wall 329 has a varying thickness. Preferably when in the form of the invention as seen in FIGS. 3*a* & 3*b*, the wall 329 has a thickness of about 0.025 inches to about 0.050 inches at the rim 302*b* where the long hollow frustum 305 is joined to the hemispherical portion 3. The wall 329 thickness then is adjusted to obtain the desired strength, internal volume, and shape for the hollow frustum 205.

The hollow frustum 305 includes a fill hole 325 for the introduction of material into the long hollow frustum 305 after it is joined to the hemispherical portion 3. Since a long hollow frustum 305 is used, a longer fill channel connects the fill hole 325 with the interior chamber of the long hollow frustum 305. After introduction of the material through the fill hole 325, the fill hole is sealed and a generally smooth surface is presented by the projectile in the region of the fill hole 325.

Figure 4A:
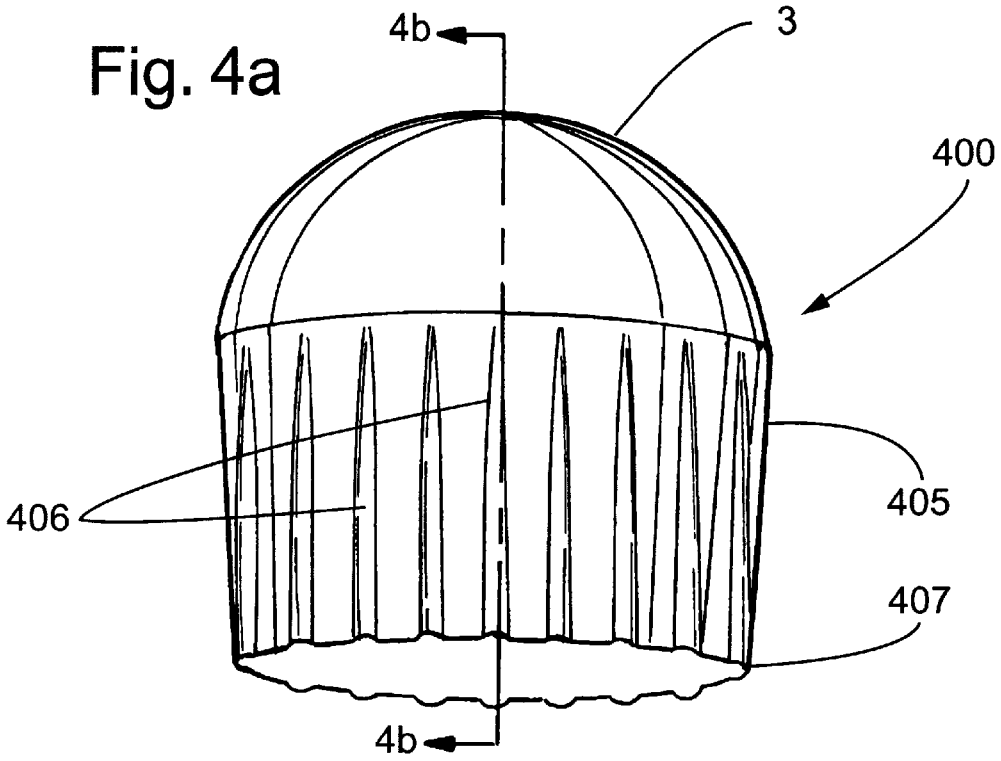
FIG. 4*a* is a perspective view of a fourth embodiment of the projectile according to the present invention.
Figure 4B:
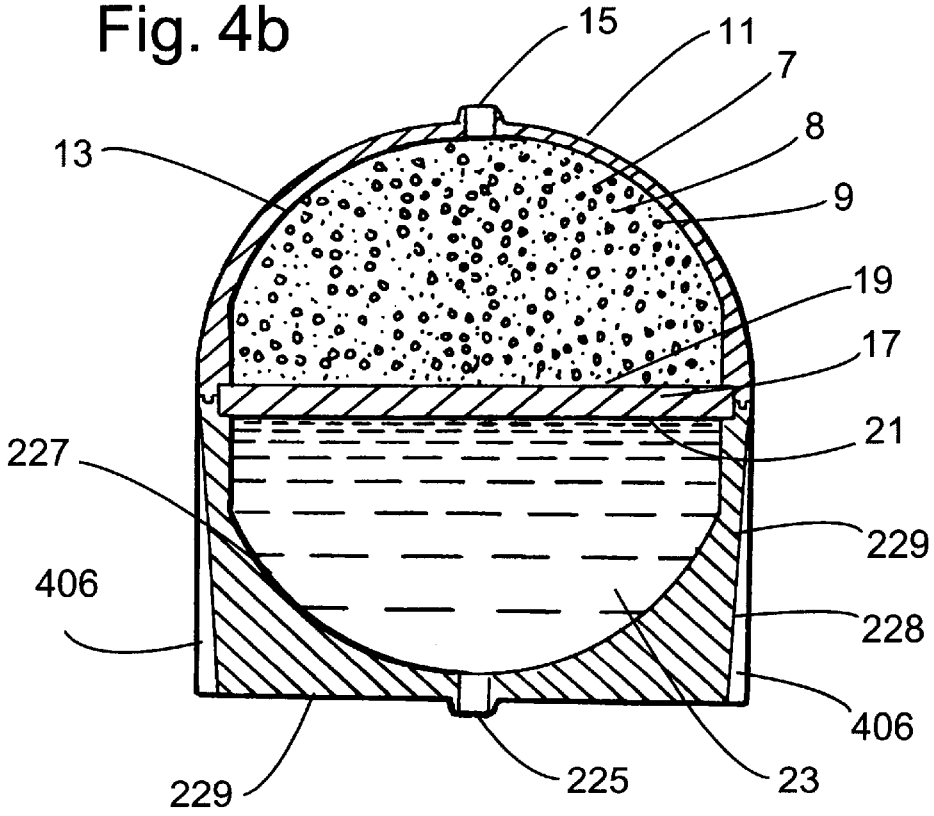
FIG. 4*b* is a cross-sectional view along the line 4*b* of the projectile of FIG. 4*a*.

A fourth embodiment 400 of the present invention is seen in FIGS. 4*a* and 4*b*. The fourth embodiment is identical to that seen in FIGS. 2*a*, 2*b* & 2*c* except that fins 406 have been added to the exterior surface of the hollow frustum. Fins are added to promote stable accurate flight. Preferably the fins exhibit curvature around the surface of the hollow frustum. Such curvature imparts a spinning motion to the projectile as it flies through the air. Such spinning motion imparts added stability and accuracy to the projectile when fired increasing the probability of hitting the intended target.

Preferably, there are at least four fins, more preferably at least eight fins and, even more preferably, there are sixteen fins 406 spaced equal distances apart around the surface of the hollow frustum. The fins 406 extend from at or near the rim 202*b* of the hollow frustum 405 and extend to the base of the hollow frustum. The extensions of the fins beyond the surface of the hollow frustum 405 begins initially at zero to very nearly zero and increase gradually along the length of the hollow frustum 405 such that the overall diameter of the finned hollow frustum 407 is about equal to the outside diameter of the hemispherical portion 3. Given the decreasing diameter of the hollow frustum 405 itself, this yields fins 406 which extend from the surface of the hollow frustum 405 in ever increasing amounts. At the base of the hollow frustum, the fins 406 preferably extend about 0.032 inches from the surface 228 of the hollow frustum 405. Preferably, where there are sixteen fins 406, the fins have a width at their initiation point at or near the rim of about 0.020 inches and width of about 0.020 inches at the point where the fins 406 end at the base of the hollow frustum 405.

Even more preferable when applying fins 406 to the surface of the hollow frustum 405 is for the fins to curve slightly as they traverse the length of the hollow frustum 405. Preferably, a single fin 406 will curve around approximately 0.0708 revolutions per inch of fin length.

Figure 5A:
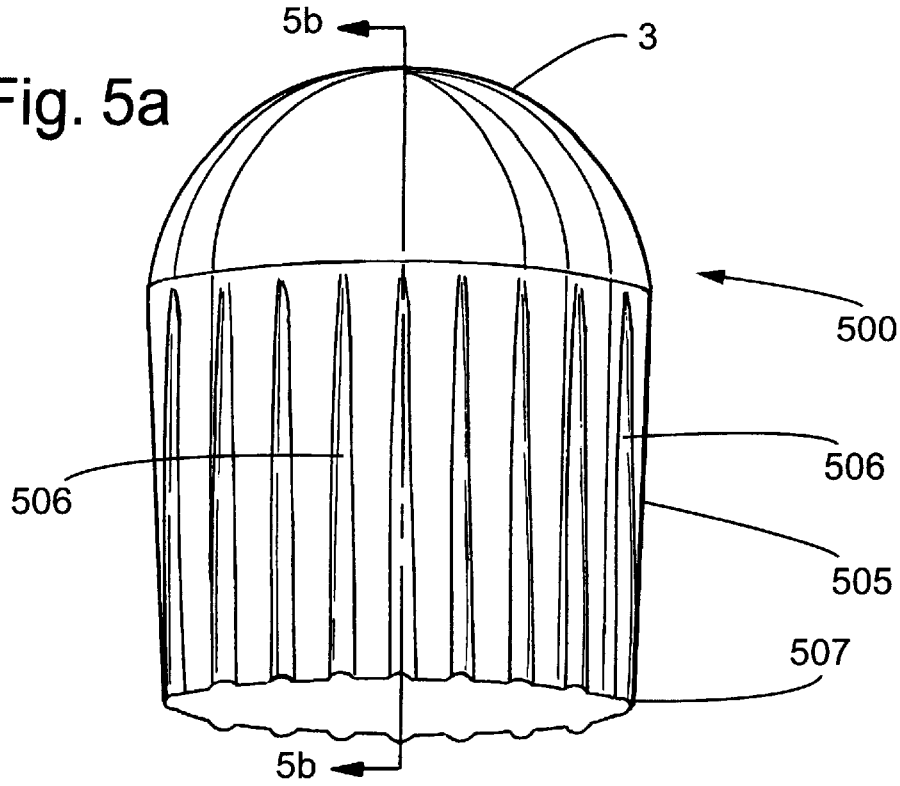
FIG. 5*a* is a perspective view of a fifth embodiment of the projectile according to the present invention.
Figure 5B:
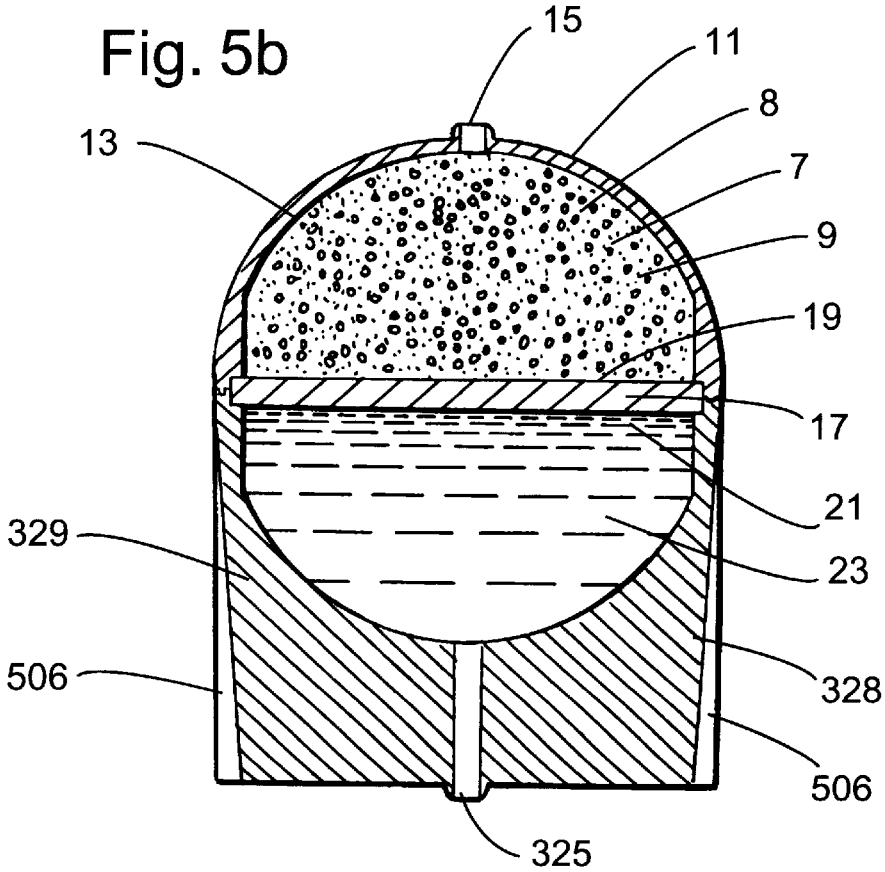
FIG. 5*b* is a cross-sectional view along the line 5*b* of the projectile of FIG. 5*a*.

A fifth embodiment 500 of the present invention is seen in FIGS. 5*a* and 5*b*. The fifth embodiment is identical to that seen in FIGS. 3*a* & 3*b* except that fins 506 have been added to the exterior surface of the long hollow frustum. Fins are added to promote stable accurate flight. Preferably the fins exhibit curvature around the surface of the hollow frustum. Such curvature imparts a spinning motion to the projectile as it flies through the air. Such spinning motion imparts added stability and accuracy to the projectile when fired increasing the probability of hitting the intended target.

Preferably, there are at least four fins, more preferably at least eight fins and, even more preferably, there are sixteen fins 506 spaced equal distances apart around the surface of the hollow frustum. The fins 506 extend from at or near the rim 202*b* of the long hollow frustum 505 and extend to the base of the long hollow frustum. The extensions of the fins beyond the surface of the long hollow frustum 505 begins initially at zero to very nearly zero and increase gradually along the length of the long hollow frustum 505 such that the overall diameter of the finned long hollow frustum 507 is about equal to the outside diameter of the hemispherical portion 3. Given the decreasing diameter of the long hollow frustum 505 itself, this yields fins 506 which extend from the surface of the long hollow frustum 505 in ever increasing distances. At the base of the long hollow frustum, the fins 506 preferably extend 0.045 inches from the surface 328 of the long hollow frustum 505. Preferably, where there are sixteen fins 506, the fins have a width at their initiation point at or near the rim of about 0.020 inches and width of about 0.020 inches at the point where the fins 506 end at the base of the long hollow frustum 505.

As noted above, most preferable when applying fins 506 to the surface of the long hollow frustum 505 is for the fins to curve slightly as they traverse the length of the long hollow frustum. Preferably, a single fin 506 will curve around approximately 0.0708 revolutions per inch of fin length.

As noted above, the hemispherical portion 3 in each embodiment includes a fill hole 15 through which fill material may be introduced and sealed into the cavity 7 of the hemispherical portion 3. Such material is typically a fluid 8 in combination with a colorant. In addition, to obtain the desired weight relationship in the projectile, a weighting agent may be introduced into the hemispherical portion before it is joined to the cylindrical or frustum portion.

A first concern in using a non-lethal projectile is to mark the victim with in some manner to enable identification and arrest once a disturbance is ended. Generally, the cavity 7 may be filled with a coloring agent to provide marking capability. Suitable coloring agents can be liquid or powder dyes. One such suitable coloring agent is a water soluble dye dispersed in water. Such a dye ultimately may be readily washed from the skin and clothing of a victim struck by the non-lethal projectile of the present invention. This permits the victim to remove the dye after apprehension. Another suitable coloring agent is a permanent dye. Other suitable coloring agents include dyes which can be detected by infra red or ultraviolet light. Still other suitable coloring agents include dyes which glow in the dark to permit detection of identified individuals who have been marked during day light hours. In cases where the coloring agent is a chemical dye that is not compatible with the shell material, the coloring agent may be placed in miniature glass ampules which are subsequently added to the interior compartment. The use of glass ampules allows even a wider variety of chemicals to be used in combination with various shell materials. The glass ampules are introduced into the cavity 7 of the hemispherical portion 3 prior to the joining of the hemispherical and cylindrical or frustum portions.

Figure 6:
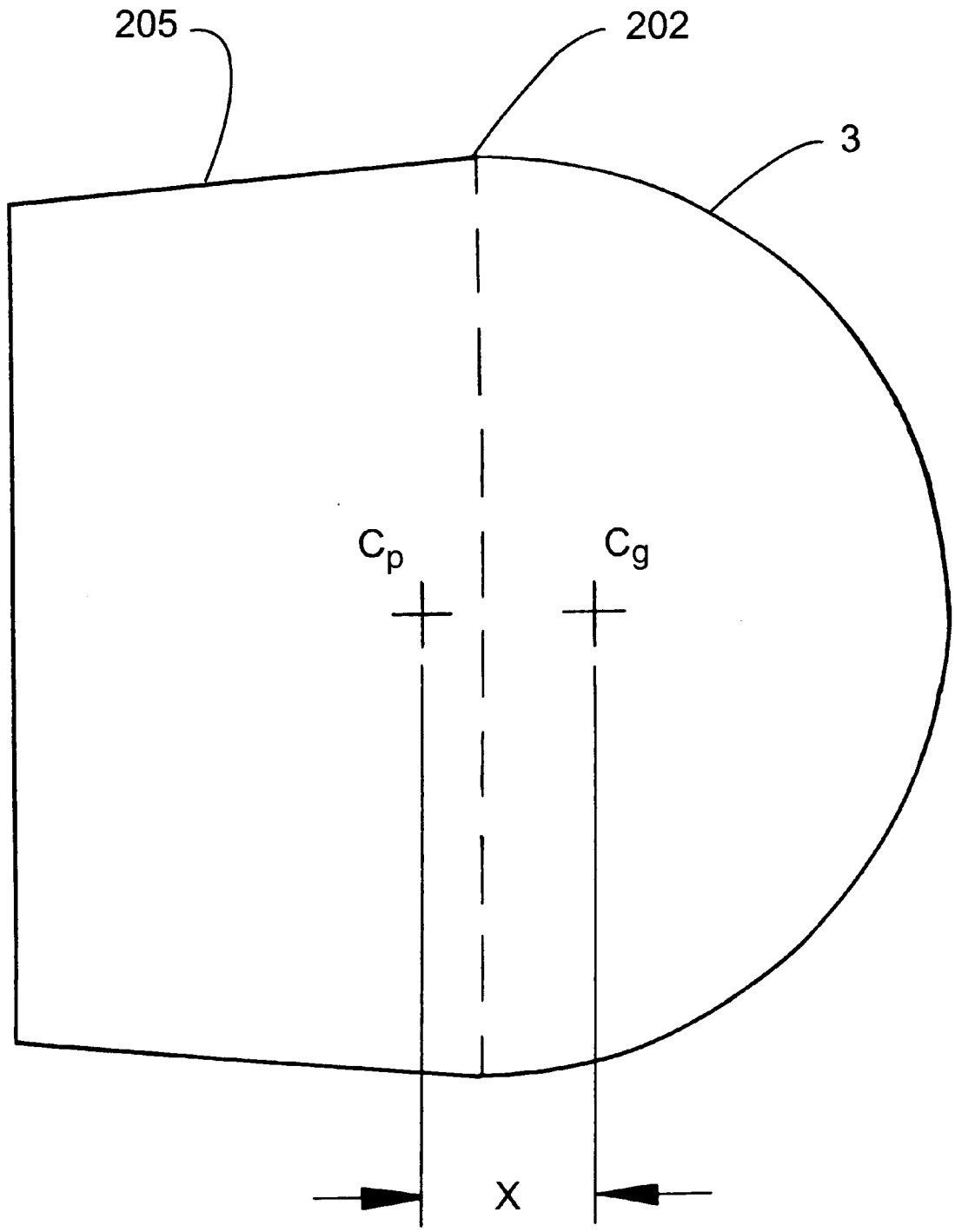
FIG. 6 is a perspective view showing the positional relationship between the preferred center of gravity (Cg) and the preferred center of pressure (Cp) for a projectile of the present invention.

Alternatively or additionally, the cavity 7 of the invention may be filled with a means of immobilizing a target, such as an irritant or other noxious chemical. The irritant or noxious chemical can be in a liquid, powder, or a gaseous state. Suitable irritants include eye irritants, such as pepper powder or tear gas. Suitable noxious agents include such chemicals as malodorants which induce nausea and/or vomiting. As discussed above, any immobilizing agent not compatible with the shell material may be placed in miniature glass ampules which are subsequently added to the interior compartment Preferably, the fill material in the cavity 7 includes the coloring agent and a weighting agent 9, such as bismuth or lead, to obtain the desired weight relationship in the projectile. The weighting agent is introduced into the cavity 7 of the hemispherical portion 3 prior to the joining of the hemispherical and cylindrical or frustum portions. Bismuth beads having a diameter of about 0.2–0.4 mm shot are the preferred weighting agent. Adding weight to the projectile improves the accuracy and aerodynamic properties of the projectile. The weighting agent is added in an amount that achieves a center of gravity (Cg) of the projectile positioned forward of the center of pressure (Cp) for the projectile when fired, as shown in FIG. 6. The center of gravity, which refers to the distribution of mass in the projectile, can be defined as the point at which the projectile would be perfectly balanced if it were suspended with no forces, other than gravity, acting on it. The center of pressure can be defined as the point at which the projectile would be balanced if it were suspended with no forces, other than air pressure, acting on it. Preferably the weighting agent is added such that the center of gravity is positioned as far forward as possible and is at least more forward than about 0.250 inches from the apex of the hemispherical portion. Also preferably the distance X between the center of gravity and the center of pressure is approximately 0.125 inches.

Adding weight to the projectile also enables the projectile to deliver a stunning blow causing a level of pain to the victim while the breakage characteristics of the projectile of the present invention generally inhibit entry of the projectile into the body as is possible with lethal bullets and supposedly non-lethal rubber bullets. The total weight of the projectile, including the projectile shell (which weighs approximately 1 gram), the filling material, and any weighting agent added, is from about 3 g to about 16 g. Preferably, the total weight of the projectile is from about 3 g to about 8 g. It should be noted that a projectile having a total weight greater than about 8 g can potentially generate an impact which causes severe injury or even death. The amount of weighting agent added is calculated according to the size and weight of the projectile shell and the desired total weight of the projectile. Specifically, the amount of weighting agent added is that amount which, in combination with the filling material, has sufficient volume to fill the interior cavity and sufficient weight to produce the desired total weight of the projectile, taking into consideration the weight of the projectile shell.

As also noted above in the various embodiments, the cylindrical portion 3, the hollow frustum 205, 405 and the long hollow frustum 305, 505 each have an interior compartment 23 which may be filled through a fill hole 25, 225, 325. Generally, the interior compartment 23 may be filled with a coloring agent to provide added marking capability. Suitable coloring agents can be liquid or powder dyes. One such suitable coloring agent is a water soluble dye dispersed in water. Such a dye ultimately may be readily washed from the skin and clothing of a victim struck by the non-lethal projectile of the present invention. This permits the victim to remove the dye after apprehension. Another suitable coloring agent is a permanent dye. Other suitable coloring agents include dyes which can be detected by infra red or ultraviolet light. Still other suitable coloring agents include dyes which glow in the dark to permit detection of identified individuals who have been marked during day light hours. In cases where the coloring agent is a chemical dye that is not compatible with the shell material, the coloring agent may be placed in miniature glass ampules which are subsequently added to the interior compartment. The glass ampules are introduced into the cavity 23 of the cylindrical portion 3, the hollow frustum 205, 405 and the long hollow frustum 305, 505 prior to the joining of the hemispherical and cylindrical or frustum portions.

Alternatively or additionally, the interior compartment 23 of the invention may be filled with a means of immobilizing a target, such as an irritant or other noxious chemical. The irritant or noxious chemical can be in a liquid, powder, or a gaseous state. Suitable irritants include eye irritants, such as pepper powder or tear gas. Suitable noxious agents include such chemicals as malodorants, which induce nausea and/or vomiting. As discussed above, any immobilizing agent not compatible with the shell material may be placed in miniature glass ampules which are subsequently added to the interior compartment.

The cavity 7 is preferably filled by inserting an injection needle into the fill hole 15 and the coloring agent, such as a vegetable dye dissolved in water, is injected into the cavity 7. After withdrawing the injection needle, a heat needle is applied to the fill hole 15 thus sealing the hemispherical portion 3. This seal is best effected when the resulting seal thickness is identical to the general thickness of the hemispherical portion 3. Likewise, the interior compartment 23 is filled by inserting an injection needle into the fill hole 25 and the coloring agent, such as a vegetable dye dissolved in water, is injected into the interior compartment 23. After withdrawing the injection needle from each fill hole, a heat needle is applied thus sealing the fill hole. Especially for the hemispherical portion 3, this seal is best effected when the resulting seal thickness is identical to the general thickness of the hemispherical portion 3.

The filled and sealed ball should then have any flashing caused by the joining of the first portion 15 to the second portion 17 and the sealing of the fill port 35 removed.

When fired at a target such as a person, animal, or other target, the projectile of the present invention strikes the target. Samples of the various embodiments of the present invention were prepared and fired at standing targets. Example 1 was made according to the invention as seen in FIGS. 1*a* & 1*b*. Example 2 was made according to the invention as seen in FIGS. 2*a* & 2*b*. Example 3 was made according to the invention as seen in FIGS. 3*a* & 3*b*. Example 4 was made according to the invention as seen in FIGS. 4*a* & 4*b*. Example 5 was made according to the invention as seen in FIGS. 5*a* & 5*b*. When the examples of the present invention were made according to the invention and fired at stationary targets, the following results were obtained:

| Example | Accuracy | Efficiency | Controlled Spin | Oriented Flight |
|---|---|---|---|---|
| 1 | Bad | OK | No | No |
| 2 | OK | Good | No | No |
| 3 | OK | Good | No | Yes |
| 4 | Good | Good | Yes | Yes |
| 5 | Good | Good | Yes | Yes |

In the above chart, efficiency is defined as the volume of gas needed to bring the projectile to a desired velocity, with a higher velocity indicating better efficiency.

In the embodiments of the invention which achieve oriented flight (i.e. no tumbling of the projectile during flight), the target is first struck by the leading edge of the hemispheric portion 3. The ease of fracture of the hemispheric portion 3 results in easy marking of the victim. At the same time, the weight of the non-lethal projectile of the present invention stuns the victim causing the victim to either cease or reconsider its course of conduct.

While only certain embodiments have been set forth, alternative embodiments and various modifications will be apparent to those skilled in the art. These and other alternatives are considered equivalents and within the spirit and scope of the present invention.

What is claimed is:

1. A projectile shell comprising a generally hemispherical portion and a generally cylindrical portion, said hemispherical portion having an inner surface and an outer surface which forms a wall and a hemispheric interior volume and said cylindrical portion having an inner surface and an outer surface which forms a wall and an interior volume having the same general shape and volume as the interior of the hemispherical portion, wherein said cylindrical portion has a length which is at least about equal to one-half the diameter of said hemispherical portion, and wherein said hemispherical portion is joined to said cylindrical portion at a rim.

2. The projectile shell according to claim 1, wherein said shell is comprised of a linear polymer.

3. The projectile shell according to claim 2, wherein said linear polymer is polystyrene.

4. The projectile shell according to claim 2, wherein said linear polymer is molecularly oriented along circumferential lines extending from the apex of said hemispherical portion toward said cylindrical portion.

5. The projectile shell according to claim 1, wherein said wall of said hemispherical portion has a thickness of from about 0.005 inches to about 0.040 inches and said wall of said cylindrical portion has a thickness of from about 0.025 inches to about 0.050 inches measured at or near the rim where said cylindrical portion is joined to said hemispherical portion.

6. The projectile shell according to claim 1, wherein a circular insert having a first wall facing the interior volume of the hemispherical portion and a second wall facing the interior volume of the cylindrical portion is placed between the hemispherical and cylindrical portions prior to joining said hemispherical portion to said cylindrical portion, said circular insert effectively isolating said interior volume of said hemispherical portion from said interior volume of said cylindrical portion.

7. The projectile shell according to claim 6, wherein said circular insert has a thickness of from about 0.010 inches to about 0.040 inches and a diameter of from about 0.620 inches to about 0.635 inches.

8. A projectile shell comprising a generally hemispherical portion and a frustum portion, said hemispherical portion having an inner surface and an outer surface which forms a wall and a hemispheric interior volume and said frustum portion having an inner surface and an outer surface which forms a wall and an interior volume having the same general shape and volume as the interior of the hemispherical portion, wherein said frustum has a diameter at its wide end which is about equal to the diameter of the hemispherical portion and a length which is at least about equal to one-half of that diameter, and wherein said hemispherical portion is joined to said wide end of said frustum portion at a rim.

9. The projectile shell according to claim 8, wherein said frustum portion has a diameter at its narrow end which is at least about 0.625 inches.

10. The projectile shell according to claim 8, wherein said shell is comprised of a linear polymer.

11. The projectile shell according to claim 10, wherein said linear polymer is polystyrene.

12. The projectile shell according to claim 10, wherein said linear polymer is molecularly oriented along circumferential lines extending from the apex of said hemispherical portion toward said frustum portion.

13. The projectile shell according to claim 8, wherein said wall of said hemispherical portion has a thickness of from about 0.005 inches to about 0.040 inches and said wall of said frustum portion has a thickness of from about 0.025 inches to about 0.050 inches measured at or near the rim where said frustum portion is joined to said hemispherical portion.

14. The projectile shell according to claim 8, wherein a circular insert having a first wall facing the interior volume of said hemispherical portion and a second wall facing the interior volume of said frustum portion is placed between the hemispherical and frustum portions prior to joining said hemispherical portion to said frustum portion, said circular insert effectively isolating said interior volume of said hemispherical portion from said interior volume of said frustum portion.

15. The projectile shell according to claim 14, wherein said circular insert has a thickness of from about 0.010 inches to about 0.040 inches and a diameter of from about 0.620 inches to about 0.635 inches.

16. The projectile shell according to claim 8, wherein said frustum portion includes at least four fins spaced equal distances apart on its exterior surface.

17. The projectile shell according to claim 16, wherein said frustum portion includes sixteen fins spaced equal distances apart on its exterior surface.

18. The projectile shell according to claim 17, wherein said fins of said frustum portion are curved around the exterior surface about 0.0708 revolutions per inch of fin length.

19. The projectile shell according to claim 8, wherein the length of said frustum portion is greater than one-half of the diameter of the hemispherical portion.

20. The projectile shell according to claim 19, wherein the length of said frustum portion is about 0.500 inches.

21. The projectile shell according to claim 19, wherein said frustum portion includes sixteen fins spaced equal distances apart on its exterior surface.

22. The projectile shell according to claim 21, wherein said fins of said frustum portion are curved around the exterior surface about 0.0708 revolutions per inch of fin length.

23. A projectile comprising:

(a) a shell comprising a generally hemispherical portion and a generally cylindrical portion welded to the hemispherical portion at a rim, said hemispherical portion having an inner surface and an outer surface defining a wall and a hemispherical interior volume and a cylindrical portion having an inner surface and cylindrical outer surface defining a wall and an interior volume, wherein at least a portion of the inner surface located in spaced relation to the rim has a diameter that is less than the diameter of the hemispherical portion measured at the rim, said cylindrical portion has a length which is at least one-half the diameter of said hemispherical portion, and (b) a marking composition located at least within said interior volume of said hemispherical portion.

24. The projectile according to claim 23, further comprising means for immobilizing said target struck by said projectile located at least within said interior volume of said hemispherical portion.

25. The projectile according to claim 23, wherein the center of gravity is positioned more forward than the center of pressure.

26. The projectile according to claim 23, wherein said shell is comprised of a linear polymer.

27. The projectile according to claim 26, wherein said linear polymer is polystyrene.

28. The projectile according to claim 23, wherein said means for marking a target is selected from the group consisting of a liquid dye, a powder dye, a water soluble dye, a permanent dye, an infra red dye, an ultra violet dye, a dye that glows in the dark, and a radiotransmitter.

29. The projectile according to claim 24, wherein said means for immobilizing said target is selected from the group consisting of a liquid irritant, a powder irritant, a gaseous irritant, a pepper powder, tear gas, a noxious agent, a malodorant, and a weighting agent.

30. The projectile according to claim 29, wherein said weighting agent is bismuth or lead or a combination of bismuth and lead.

31. The projectile according to claim 30, wherein said weighting agent is added in an amount of from about 2 g to about 15 g.

32. A projectile comprising:

(a) a generally hemispherical portion having an inner surface and an outer surface defining a wall and a hemispherical interior volume and a frustum portion having an inner surface and an outer surface defining a wall and an interior volume, wherein said frustum portion has a diameter at its wide end which is about equal to the outer diameter of the hemispherical portion, wherein said hemispherical portion is welded to said wide end of said frustum portion at a rim, (b) a marking composition located at least within said hemispherical portion.

33. The projectile according to claim 32, further comprising means for immobilizing said target struck by said projectile located at least within said hemispherical portion.

34. The projectile according to claim 32, wherein the center of gravity is positioned more forward than the center of pressure.

35. The projectile according to claim 32, wherein said projectile shell is comprised of a linear polymer.

36. The projectile according to claim 35, wherein said linear polymer is polystyrene.

37. The projectile according to claim 32, wherein said means for marking a target is selected from the group consisting of a liquid dye, a powder dye, a water soluble dye, a permanent dye, an infra red dye, an ultra violet dye, a dye that glows in the dark, and a radiotransmitter.

38. The projectile according to claim 33, wherein said means for immobilizing said target is selected from the group consisting of a liquid irritant, a powder irritant, a gaseous irritant, a pepper powder, tear gas, a noxious agent, a malodorant, and a weighting agent.

39. The projectile according to claim 38, wherein said weighting agent is bismuth or lead, or a combination of bismuth and lead.

40. The projectile according to claim 39, wherein said weighting agent is added in an amount of from a bout 2 g to about 15 g.

41. The projectile according to claim 32, wherein said frustum portion of said projectile shell includes at least four fins spaced equal distances apart on its exterior surface.

42. The projectile according to claim 41, wherein said frustum portion of said projectile shell includes sixteen fins spaced equal distances apart on its exterior surface.

43. The projectile according to claim 32, wherein the length of said frustum portion of said projectile shell is greater than one-half of the diameter of the hemispherical portion.

44. The projectile according to claim 43, wherein said frustum portion of said projectile shell includes sixteen fins spaced equal distances apart on its exterior surface.

45. A method of producing a projectile having a hemispherical shell and a cylindrical shell comprising:

(a) injecting a linear polymer into a first mold, forming a hemispherical shell having a hemispheric inner wall, a hemispheric outer wall, an interior volume, and a fill port, said inner and outer walls forming a rim;

(b) injecting a linear polymer into a second mold, forming a cylindrical shell having a hemispheric inner wall, a cylindrical outer wall, an interior volume, and a fill port, said inner and outer walls forming a rim which mates with the profile of said hemispherical shell rim and which mated profile allows capture of a circular insert;

(c) forming a circular insert having a first wall which faces the interior volume of the hemispherical shell and a second wall which faces the interior volume of the cylindrical shell;

(d) placing said circular insert between said hemispherical shell and said cylindrical shell;

(e) joining said hemispherical shell, said cylindrical shell, and said circular insert together along said hemispherical shell rim and said cylindrical shell rim, forming a projectile shell wherein said interior volume of said hemispherical shell is isolated from said interior volume of said cylindrical shell;

(f) dispensing into said projectile shell through said hemispherical fill port means for marking a target struck by said projectile to permit identification of said target;

(g) sealing said fill port;

(h) removing any flashing created during the joining of said hemispherical shell with said cylindrical shell and removing any flashing created during the sealing of said fill port.

46. A method of producing a projectile having a hemispherical shell and a frustum shell comprising:

(a) injecting a linear polymer into a first mold, forming a hemispherical shell having a hemispheric inner wall, a hemispheric outer wall, an interior volume, and a fill port, said inner and outer walls forming a rim;

(b) injecting a linear polymer into a second mold, forming a frustum shell having a hemispheric inner wall, a frustum outer wall, an interior volume, and a fill port, said inner and outer walls forming a rim which mates with the profile of said hemispherical shell rim and which mated profile allows capture of a circular insert;

(c) forming a circular insert having a first wall which faces the interior volume of the hemispherical shell and a second wall which faces the interior volume of the frustum shell;

(d) placing said circular insert between said hemispherical shell and said frustum shell;

(e) joining said hemispherical shell, said frustum shell, and said circular insert together along said hemispherical shell rim and said frustum shell rim, forming a projectile shell wherein said interior volume of said hemispherical shell is isolated from said interior volume of said frustum shell;

(f) dispensing into said projectile shell through said hemispherical fill port means for marking a target struck by said projectile to permit identification of said target (g) sealing said fill port;

(h) removing any flashing created during the joining of said hemispherical shell with said frustum shell and removing any flashing created during the sealing of said fill port.

47. The projectile of claim 32, wherein at least a portion of the inner surface located in spaced relation to the rim has a diameter that is less than the diameter of the hemispherical portion measured at the rim.

48. A projectile for compressed gas guns consisting essentially of (a) a shell comprising a first portion comprising a polymer and having an inner surface and a generally hemispherical outer surface defining a wall and an interior volume and a second portion having an inner surface and an outer surface defining a wall and an interior volume, said outer surface of the second portion generally shaped in the form of a cylinder or frustum, wherein said second portion has a length of at least about one-half the diameter of said first portion, and wherein said first portion is joined to said second portion at a rim, and (b) a marking composition located at least within said interior volume of said first portion.

49. The projectile of claim 48, wherein the shell further comprises an insert that separates the interior volume of the first portion and the interior volume of the second portion.

50. The projectile of claim 48, wherein the shell further comprises a plurality of fins located on the outer surface of the second portion.

51. The projectile of claim 48, wherein the first and second portions are joined by welding.

52. A method for marking an object with a marking composition comprising loading a projectile into a compressed gas gun, the projectile consisting essentially of (a) a shell comprising a first portion comprising a polymer that fractures upon impact with the target and having an inner surface and a generally hemispherical outer surface defining a wall and an interior volume and a second portion having an inner surface and an outer surface defining a wall, said outer surface of the second portion generally shaped in the form of a cylinder or frustum, wherein said second portion has a length least about equal to one-half the diameter of said first portion, and wherein said first portion is joined to said second portion at a rim, and (b) a marking composition located at least within said interior volume of said first portion, firing the projectile from the compressed gas gun toward the target, wherein at least a portion of the projectile shell fractures upon impact with the target, causing the marking composition within the projectile to come into contact with the target.

* * * * *